US009074446B2

(12) United States Patent
Kristensen et al.

(10) Patent No.: US 9,074,446 B2
(45) Date of Patent: Jul. 7, 2015

(54) SYSTEM AND METHOD FOR CONTROLLING THE PRESSURE IN A HYDROCARBON WELL

(75) Inventors: Per Herbert Kristensen, Rykkinn (NO); Lars Martin Sørhaug, Nærsnes (NO); Knut A. Sveen, Bekkestua (NO); Morten Bøhlerengen, Nordre Frogn (NO)

(73) Assignee: MOSS MARITIME AS, Lysaker (NO)

( * ) Notice: Subject to any disclaimer, the term of this patent is extended or adjusted under 35 U.S.C. 154(b) by 0 days.

(21) Appl. No.: 14/006,922

(22) PCT Filed: Mar. 23, 2012

(86) PCT No.: PCT/EP2012/055194

§ 371 (c)(1), (2), (4) Date: Dec. 2, 2013

(87) PCT Pub. No.: WO2012/127028

PCT Pub. Date: Sep. 27, 2012

(65) Prior Publication Data

US 2014/0174753 A1 Jun. 26, 2014

(30) Foreign Application Priority Data

Mar. 24, 2011 (NO) ..... 20110451
Dec. 12, 2011 (NO) ..... 20111710

(51) Int. Cl.
*E21B 19/00* (2006.01)
*E21B 33/038* (2006.01)
(Continued)

(52) U.S. Cl.
CPC ..... *E21B 33/038* (2013.01); *E21B 19/006* (2013.01); *E21B 21/08* (2013.01); *E21B 33/06* (2013.01)

(58) Field of Classification Search
CPC ..... E21B 7/12; E21B 19/006; E21B 21/08; E21B 33/038; E21B 33/06
USPC ..... 166/350, 352, 355, 358, 367; 175/5; 405/196, 224.2–224.4
See application file for complete search history.

(56) References Cited

U.S. PATENT DOCUMENTS 4,694,909 A * 9/1987 Stephenson et al. ..... 166/356
5,533,574 A * 7/1996 Gonzalez ..... 166/358

(Continued)

FOREIGN PATENT DOCUMENTS

GB 2 412 130 A 9/2005
NO 310986 B1 9/2001

(Continued)

*Primary Examiner* — Matthew Buck
(74) *Attorney, Agent, or Firm* — Birch, Stewart, Kolasch & Birch, LLP

(57) ABSTRACT

A system (10) for managed pressure drilling, or for workover of a hydrocarbon well with a wellhead, the system comprising a floating structure that is located in a body of water (41). A method is also described for connecting up the system for managed pressure drilling or well workover. The floating structure comprises a drill floor (13) and a work deck (14) that is movably arranged in an essentially vertical direction in relation to the drill floor. The system further comprises a riser (28) and a slip joint (32) that is connected to the underside of the work floor and to the upper end of the riser such that the work deck can be moved relative to the riser. The riser extends from the slip joint down to a wellhead valve device (40) arranged on the wellhead of the hydrocarbon well. The floating arrangement also comprises heave-compensated riser tensioners (17) which are connected to the slip joint such that the riser is held under tension. The system further comprises a BOP (38) that is arranged on the work deck and a high-pressure riser (29) that is arranged through the riser and the slip joint and is connected to the BOP on the work deck and to the wellhead valve device, thereby forming a continuous high-pressure connection from the work deck down to the hydrocarbon well (45).

20 Claims, 7 Drawing Sheets

(51) Int. Cl.
*E21B 33/06* (2006.01)
*E21B 21/08* (2006.01)

(56) References Cited

U.S. PATENT DOCUMENTS

| | | | | |
|---|---|---|---|---|
| 6,273,193 | B1 * | 8/2001 | Hermann et al. | 166/359 |
| 6,470,969 | B1 * | 10/2002 | Sørhaug et al. | 166/355 |
| 7,188,677 | B2 * | 3/2007 | Moe | 166/355 |
| 7,334,967 | B2 * | 2/2008 | Blakseth et al. | 405/224.2 |
| 7,686,544 | B2 * | 3/2010 | Blakseth et al. | 405/224.2 |
| 2006/0219411 | A1 * | 10/2006 | Moksvold | 166/345 |
| 2007/0084606 | A1 * | 4/2007 | Ponville | 166/355 |
| 2007/0095540 | A1 | 5/2007 | Kozicz et al. | |
| 2008/0031692 | A1 * | 2/2008 | Wybro et al. | 405/224.4 |
| 2008/0105434 | A1 | 5/2008 | Orbell et al. | |
| 2008/0251257 | A1 | 10/2008 | Leuchtenberg | |
| 2008/0251258 | A1 * | 10/2008 | Bamford | 166/355 |
| 2011/0005767 | A1 * | 1/2011 | Muff et al. | 166/345 |
| 2011/0240305 | A1 * | 10/2011 | Kristensen et al. | 166/345 |
| 2012/0160508 | A1 * | 6/2012 | Thommesen | 166/355 |

FOREIGN PATENT DOCUMENTS

| | | | |
|---|---|---|---|
| NO | 329333 | B1 | 9/2010 |
| WO | WO 03/067023 | A1 | 8/2003 |
| WO | WO 2010/071444 | A1 | 6/2010 |

* cited by examiner

SYSTEM AND METHOD FOR CONTROLLING THE PRESSURE IN A HYDROCARBON WELL

The present invention relates to a system for managed pressure drilling or workover of a hydrocarbon well, a method for connecting up a system for managed pressure drilling or for workover of a hydrocarbon well, and to uses of the system and method for managed pressure drilling or well workover.

The system and the method are especially advantageous for use in drilling a hydrocarbon well utilising managed pressure drilling (MPD), or in connection with a well workover operation.

Managed pressure drilling is a method for drilling hydrocarbon wells where the drillability of the well is increased by controlling the pressure profile through the well so as to attempt to deal with problems that may arise in a well in particular during drilling, but also during well workover (using, for example, coiled tubing). These problems may, for instance, be that the formations in the well collapse and fall into the well.

In conventional drilling, the only way to control the pressure under static conditions is to vary the weight of the drilling mud in the well. If the pressure is less than the pore pressure of the formation in which drilling is taking place, hydrocarbons may flow into the well, i.e., the well gets a kick. Before drilling can continue, the hydrocarbons must be circulated out of the well. In pressure managed drilling, the object is thus to control the pressure in the well during drilling so as to avoid these problems.

From the prior art, reference may be made to the Applicant's own Norwegian Patent No. 310986, which describes a heave-compensated work deck, and Norwegian Patent No. 329333, which describes intervention of hydrocarbon wells using a work deck as described in the first patent.

The object of the present invention is therefore to provide a system which makes it possible to carry out managed pressure drilling or managed pressure well intervention from floating arrangements.

It is also an object of the present invention that the managed pressure drilling or the managed pressure well intervention should be capable of being implemented in the case of hydrocarbon wells that are located at great water depths.

This is achieved by means of a system for managed pressure drilling or for workover of a hydrocarbon well according to claim 1 and a method for connecting up a system for managed pressure drilling or for workover of a hydrocarbon well according to claim 8, and by means of the uses according to claims 13-14. Additional embodiments of the invention are disclosed in the dependent claims. Accordingly, a system is provided for managed pressure drilling or for workover of a hydrocarbon well, the system comprising a floating structure, for example, a drilling rig or drill ship, which is located in a body of water. The floating structure comprises a drill floor and a work deck, where the work deck is movably arranged in an essentially vertical direction in relation to the drill floor when the floating structure is in calm waters. The system further comprises a riser and a telescopic or slip joint, which slip joint is connected to the underside of the work deck and to the upper end of the riser such that the work deck can be moved relative to the riser. The riser extends from the slip joint down to a wellhead valve device which is arranged on the wellhead of the hydrocarbon well. Furthermore, there is a plurality of riser tensioners, each of which is connected to the lower end of the slip joint preferably, but not necessarily, by wires, such that the riser is held under tension. The system further comprises a BOP that is arranged on the work deck when the system is in use, and a high-pressure riser that is arranged in and extends through the riser and the slip joint when the system is in use. The high-pressure riser is connected at its upper end to the BOP on the work deck and at its lower end to the wellhead valve device. A high-pressure connection is thus formed from the BOP on the work deck down to the hydrocarbon well so as to allow a managed pressure drilling operation or a managed pressure workover operation to be carried out.

The work deck is preferably arranged in an opening in the drill floor and adapted to be lockable against relative movement in relation to the drill floor.

As mentioned, each riser tensioner comprises at least one wire that is connected to a lower, fixed end of the slip joint. The system preferably also comprises a plurality of first pulley sets having at least one pulley wheel over which the respective wires of the riser tensioners run, and where the pulley sets are mounted on the work deck such that the wires run clear of an opening in a cellar deck which is arranged below the drill floor. The first pulley sets are preferably mounted on the underside of the work deck, but they may also be mounted on the upper side of the work deck and passed through openings therein.

In an embodiment of the invention, the wellhead of the hydrocarbon well, with mounted wellhead valve device, is preferably arranged on or near the bottom of the body of water.

The slip joint preferably comprises an upper telescopic member which is connected to the underside of the work deck, and a lower telescopic member which is mounted on the upper end of the riser, and the slip joint is preferably locked in a fixed position during managed pressure drilling or well workover.

A method is also provided for connecting up a system for managed pressure drilling or for workover of a hydrocarbon well, the system comprising a floating structure, for example, a drilling rig or drill ship, which is located in a body of water. The floating structure comprises a drill floor and a work deck which is movably arranged in an essentially vertical direction in relation to the drill floor. The system further comprises a riser with a slip joint, the riser extending from the work deck down to a wellhead valve device arranged on the wellhead of the hydrocarbon well. The system also comprises a plurality of riser tensioners, each of which is connected to the slip joint and compensates for heave motions such that the riser is held under tension. During connection of the system for managed pressure drilling or for well workover, the work deck is arranged in a fixed position in relation to the drill floor and a high-pressure riser is passed down through the slip joint and the riser such that the high-pressure riser extends from the work deck down to a predetermined distance above the wellhead valve device. A BOP is subsequently arranged on the work deck to the upper end of the high-pressure riser. Alternatively, a BOP is first arranged on the work deck after which a high-pressure riser is passed through the BOP, slip joint and riser so that the high-pressure riser extends from the BOP on the work deck down to a predetermined distance above the wellhead valve device. The work deck is then released and lowered until the high-pressure riser engages with and is locked to the wellhead valve device such that a high-pressure connection is established between the hydrocarbon well and the work deck on the floating arrangement.

During connection of the system for managed pressure drilling or for well workover, the work deck is arranged in a fixed position in relation to the drill floor and a high-pressure riser is passed down through the slip joint and the riser such that the high-pressure rise extends from the work deck down to a predetermined distance above the wellhead valve device. A BOP on the work deck is then arranged to the upper end of the high-pressure riser. Alternatively, a BOP can first be arranged on the work deck, after which a high-pressure riser is passed down through the BOP, the slip joint and the riser such that the high-pressure riser extends from the BOP on the work deck down to a predetermined distance above the wellhead valve device. The work deck is then released and lowered until the high-pressure riser engages with and is locked to the wellhead valve device such that a high-pressure connection is established between the hydrocarbon well and the work deck on the floating arrangement.

In a preferred embodiment of the invention, the work deck is locked in a position in which the work deck and the drill floor are essentially on the same vertical level before the BOP is passed over and mounted on the work deck.

In another embodiment of the invention, the work deck is suspended from lifting gear that is capable of holding the weight of the work deck, the BOP and the high-pressure riser, and the work deck is lowered with the aid of the lifting gear.

In an additional embodiment of the invention, the slip joint is locked in its position when the high-pressure riser has engaged with the wellhead valve device.

A non-limiting embodiment of the invention will be described below with reference to the figures, wherein.

The same reference numerals are used to refer to the same technical features of the invention in all the figures. As the figures describe the same embodiment of the invention, all the figures will be described collectively below.

Figure 1:
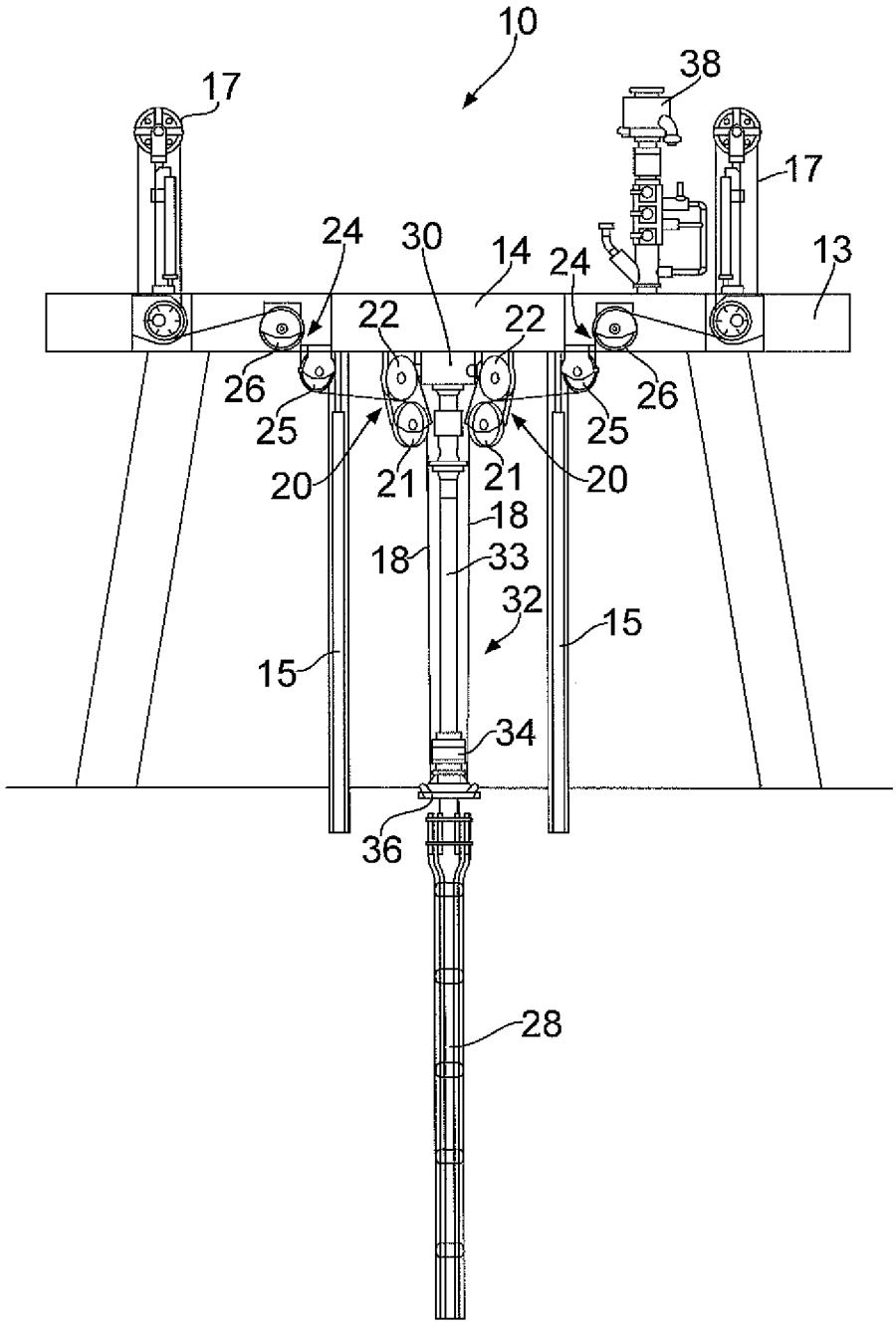
FIG. 1 is a schematic illustration of the system for normal drilling and a BOP has not been positioned on the work deck.
Figure 2:
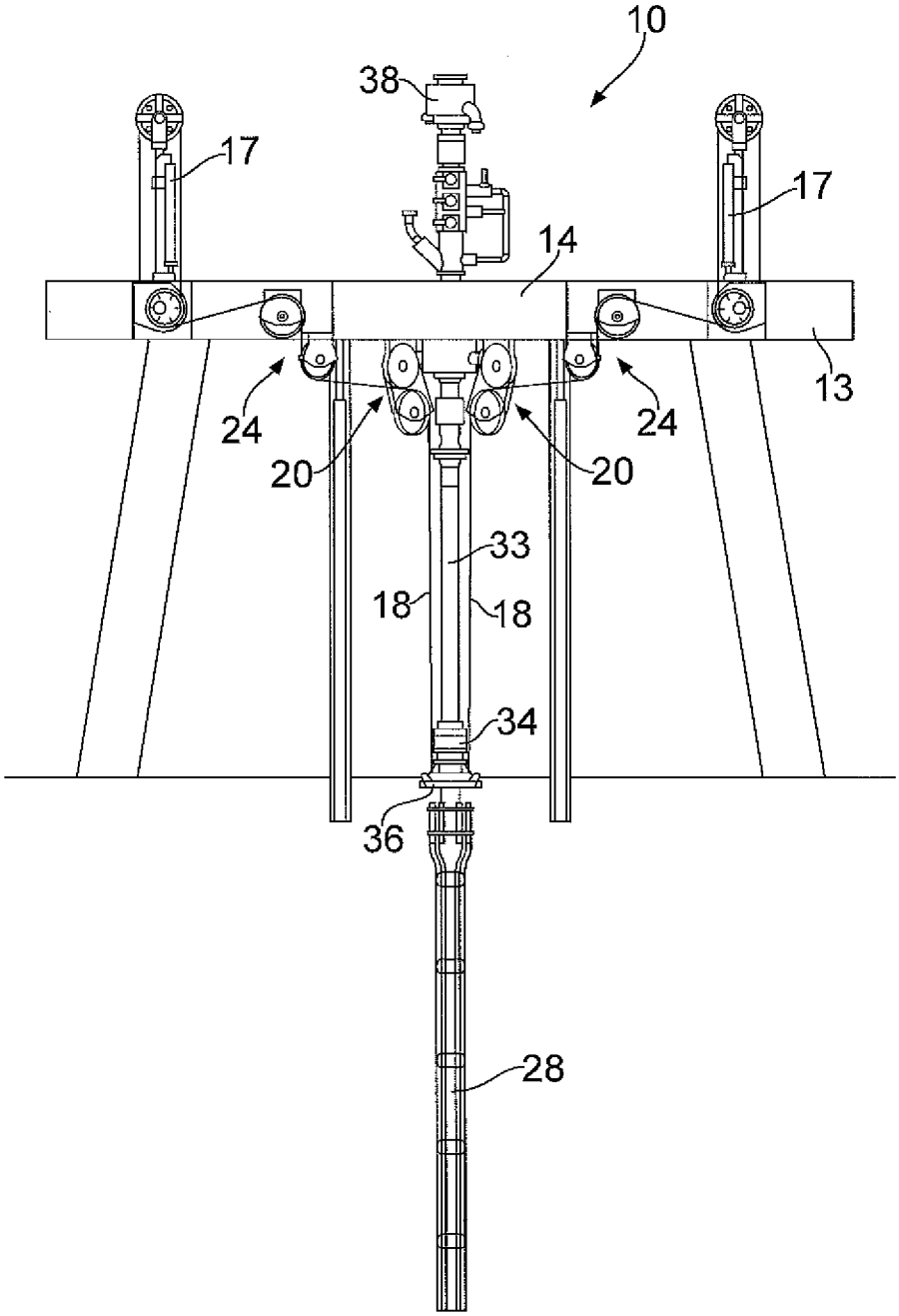
FIG. 2 is a schematic illustration of the system as alternative drilling is prepared where a BOP is passed over the work deck for mounting on the work deck and the slip joint is active.
Figure 3:
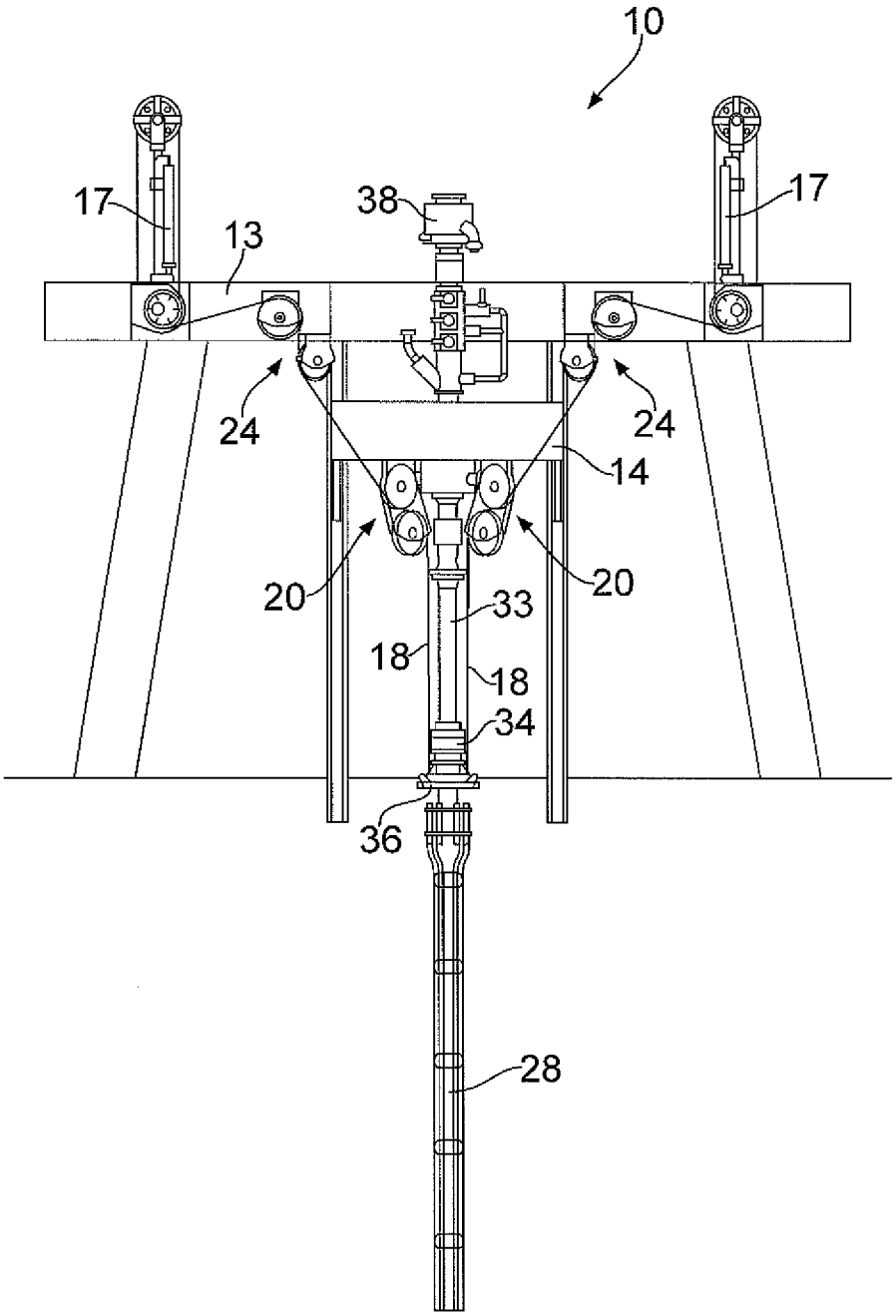
FIG. 3 is a schematic illustration of the system as alternative drilling is prepared where the work deck is lowered towards the riser and the slip joint is active.
Figure 4:
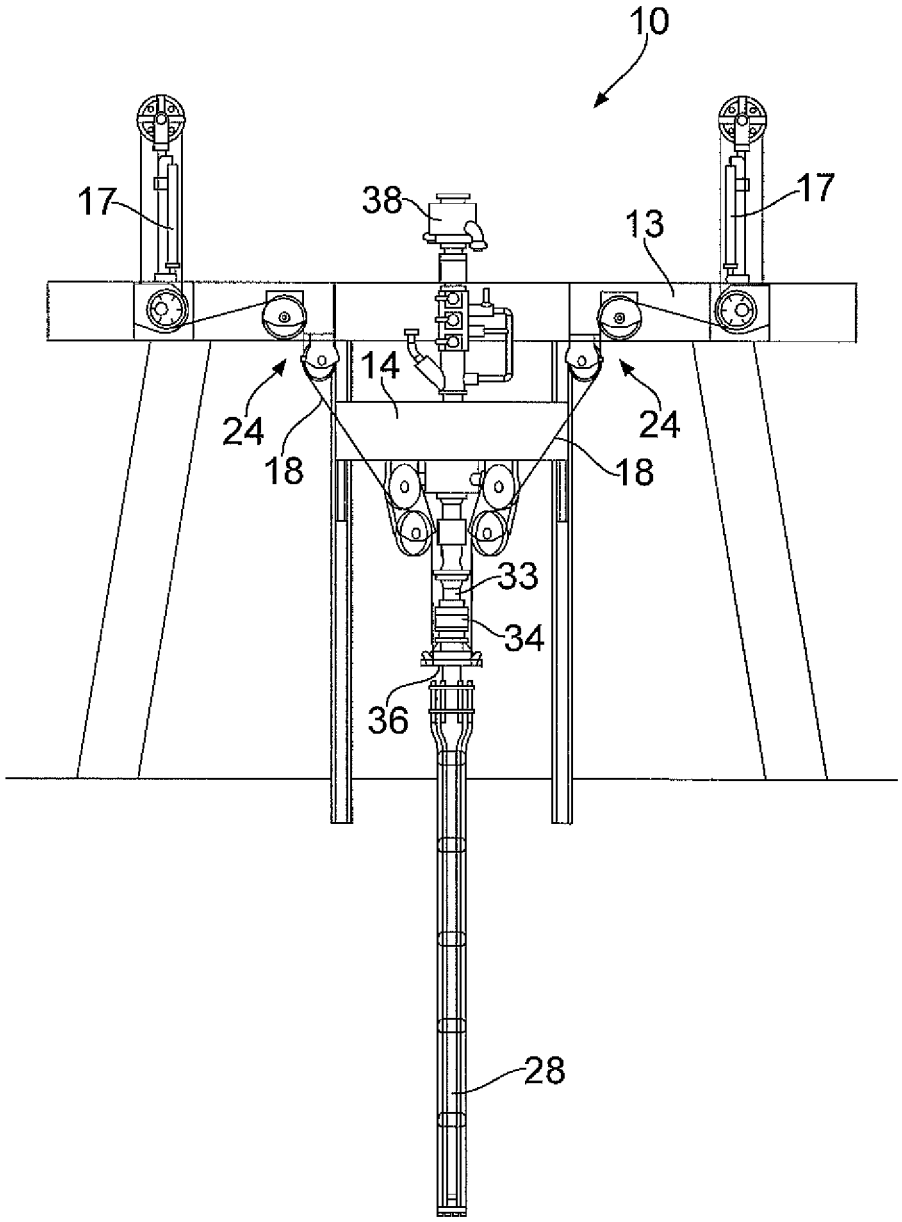
FIG. 4 is a schematic illustration of the system during alternative drilling, where the work deck is in a high position and the slip joint is locked. Riser and work deck are in a fixed position relative to the bottom, whilst the rest of the floating arrangement moves up and down relative to the work deck and the riser.
Figure 5:
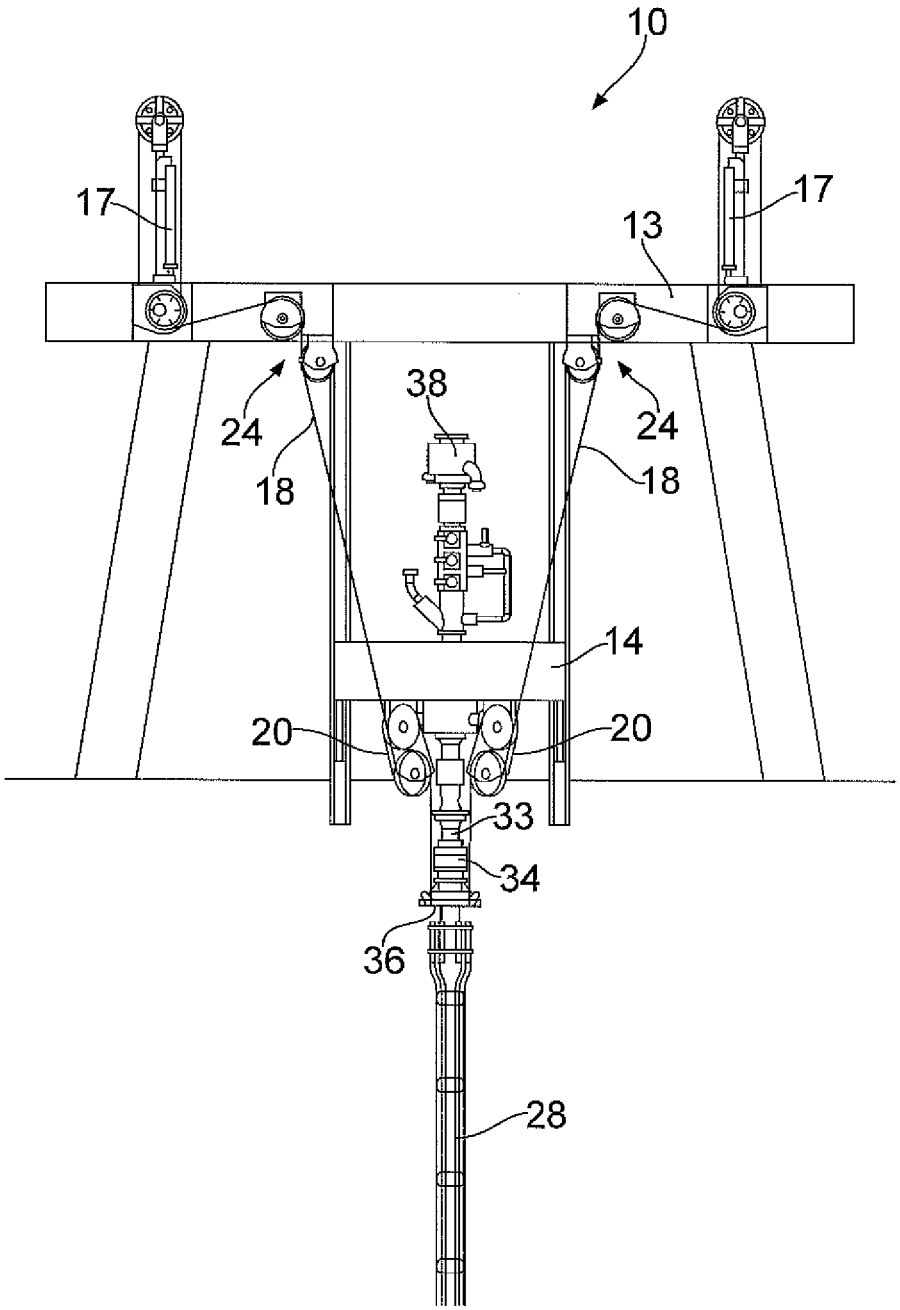
FIG. 5 is a schematic illustration of the system during alternative drilling, where the work deck is in a low position and the slip joint is locked. Riser and work deck are in a fixed position relative to the bottom, whilst the rest of the floating arrangement moves up and down relative to the work deck and the riser.
Figure 6:
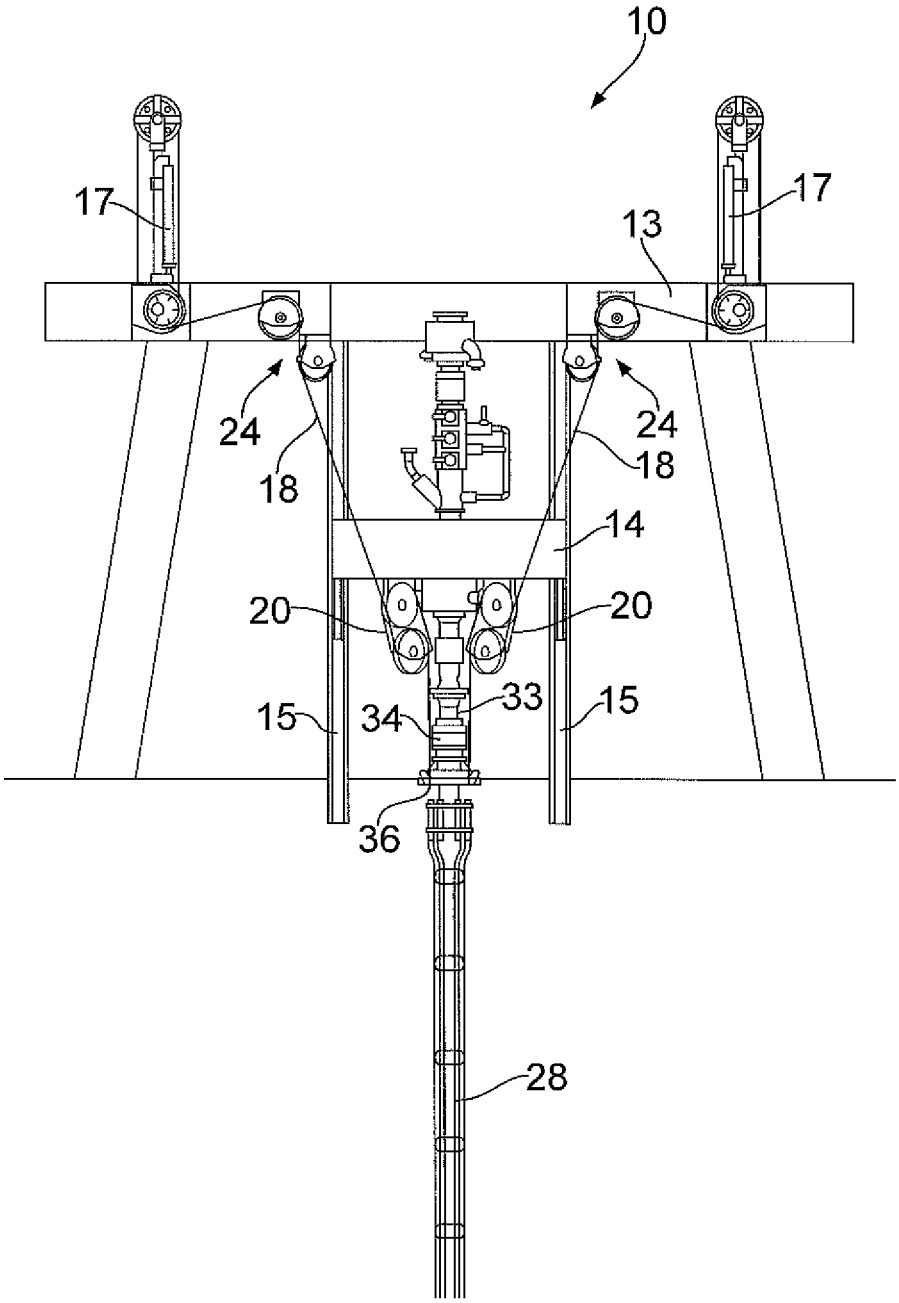
FIG. 6 is a schematic illustration of the system during alternative drilling, where the work deck is in an intermediate position and the slip joint is locked. Riser and work deck are in a fixed position relative to the bottom, whilst the rest of the floating arrangement moves up and down relative to the work deck and the riser.

The figures are a schematic illustration of a system 10 comprising a floating arrangement that is only partly shown in the figures. The floating arrangement comprises a drill floor 13 and a work deck 14 arranged in an opening in the drill floor 13. The work deck 14 is movably arranged such that it can be moved up and down in an essentially vertical direction in relation to the drill floor 13. For this purpose, guides 15 may be provided, along which the work deck 14 is moved up and down. The work deck is further arranged so that it can be locked in a desired position in relation to the drill floor 13. This is shown in FIGS. 1 and 2 where the work deck 14 is locked in a position in which it lies at essentially the same height as the drill floor 13.

On the underside of the work deck 14, there is provided a diverter 30 for drilling mud that comes up after having circulated through the well 45. On the underside of the diverter 30, there is provided a slip joint 32 comprising an upper telescopic member 33 that is fastened to the underside of the work deck 14 and a lower telescopic member 34 that is fastened to a riser 28. The riser 28 is a standard riser which extends down to a wellhead valve device 40 and which has a fairly large diameter such that it is unable to withstand high pressures. The wellhead valve device 40 will normally be a subsea BOP.

On the drill floor there is provided a plurality of riser tensioners 17 which are connected via wires 18 to a fastening ring 36 or the like on the lower telescopic member for securing the wires 18. The riser 28 is thus held under tension also when the floating arrangement moves up and down in the sea. The floating arrangement may be provided with a desired number of riser tensioners 17. In the illustrated embodiment of the invention, four riser tensioners 17 are arranged evenly distributed around the work deck 14, for example, one riser tensioner 17 at each corner if the work deck 14 is rectangular in shape.

Each wire 18 is passed from a riser tensioner 17 over a second pulley set 24 which is arranged on the drill floor 13 and comprises at least one pulley wheel, but preferably two pulley wheels 25, 26, as shown in the figures. Furthermore, the wire 18 is passed over a first pulley set 20 which is arranged on the work deck 14, preferably on the underside of the work deck. The first pulley set 20 also comprises at least one pulley wheel, but is preferably provided with two pulley wheels 21, 22. The wire 18 is passed on from the first pulley set 20 to the fastening ring 36 on the lower telescopic member 34.

Figure 7:
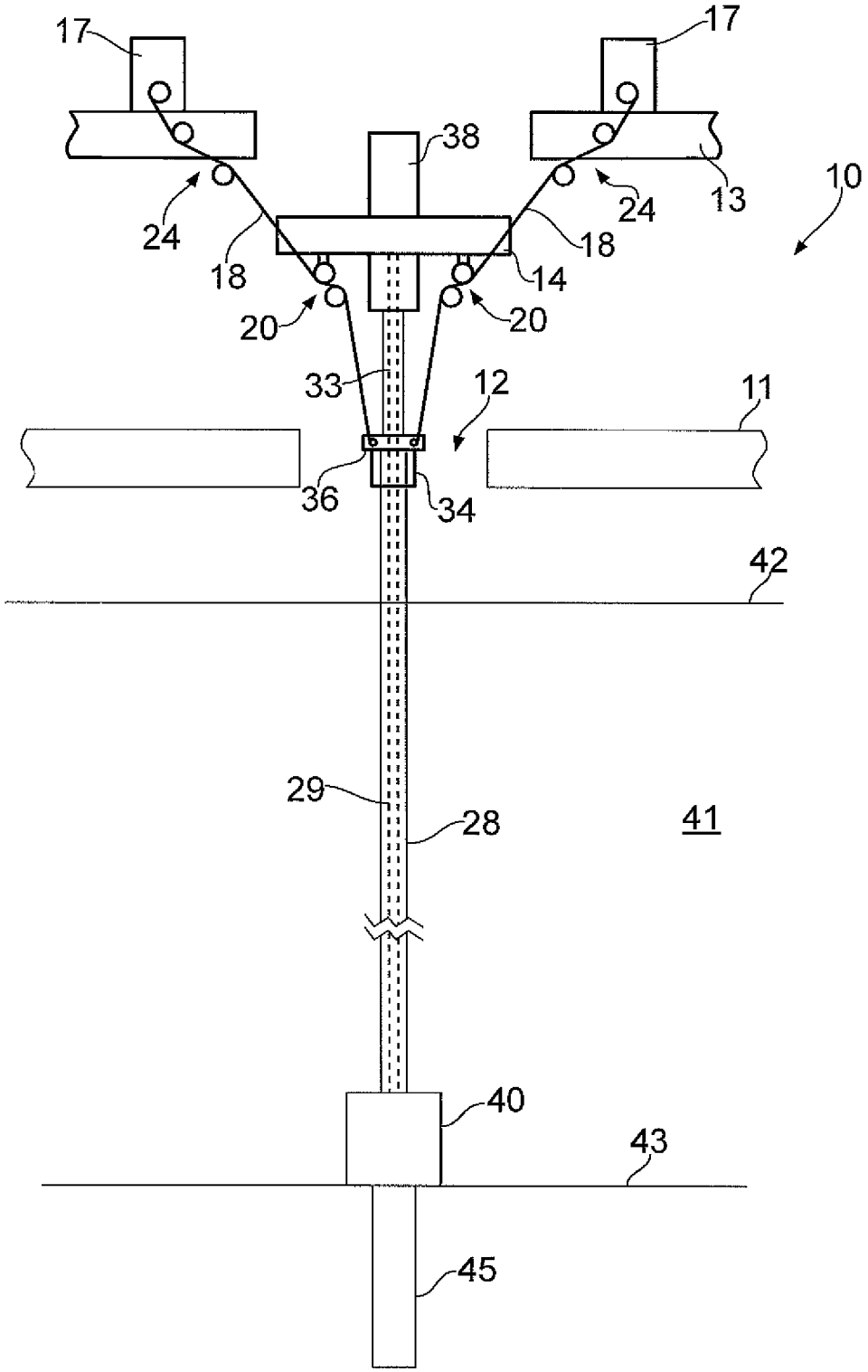
FIG. 7 is a schematic illustration of the system with the riser which extends right down to the wellhead of the hydrocarbon well at the bottom of the body of water.

The first pulley set 20 that is arranged below the work deck 14 is preferably located in towards the centre of the work deck such that the wire 18 does not get in the way of the opening 12 in the cellar deck 11 (see FIG. 7) when the work deck 14 is moved up and down and the floating arrangement moves in the sea.

When the floating arrangement is to be used for managed pressure drilling of a hydrocarbon well or an intervention in the well, the system must be prepared for such an alternative drilling operation. When the system is connected up for managed pressure drilling or intervention, the work deck 14 is moved to a position where it is on a level with the drill deck 13 as shown in FIG. 1, where the work deck preferably is locked in a fixed position in relation to the drill floor. In FIG. 1 it is also shown that the BOP 38 is located next to the work deck and is not in use (in normal drilling).

The high-pressure riser is first passed down through the slip joint 32 and the riser 28 so that the high-pressure riser extends from the work deck 14 down to a predetermined distance above the wellhead valve device. The BOP 38 is subsequently arranged on the work deck 14 and connected to the upper end of the high-pressure riser. Alternatively, the BOP 38 is first arranged on the work deck 14 after which the high-pressure riser is passed down through the BOP 38, the slip joint 32 and the riser 28 so that the high-pressure riser extends from the BOP 38 on the work deck 14 down to a predetermined distance above the wellhead valve device before the high-pressure riser is connected to the BOP 38.

The work deck 14 has now been suspended from the block (not shown in the figures), a crane or the like capable of taking the weight of the work deck, the BOP 38 and the high-pressure riser. The work deck 14 is then released and lowered until the high-pressure riser engages with and is locked to the wellhead valve device 40. A high-pressure connection is thus established from the BOP 38 on the work deck 14 down to the hydrocarbon well 45, and it is possible to carry out a managed pressure drilling operation in the hydrocarbon well, optionally a well workover operation.

When a managed pressure drilling operation is in progress, the work deck 14 and the BOP 38 that is mounted on the work deck 14 will now be locked in a fixed position in relation to the bottom 43. This means that the BOP 38 can be operated by personnel on the floating arrangement.

The invention claimed is:

1. A system for managed pressure drilling and for workover of a hydrocarbon well with a wellhead, the system comprising:

a floating structure located in a body of water, the floating structure comprising a drill floor and a work deck, the work deck being movably arranged in relation to the drill floor;

a riser and a slip joint, the slip joint being connected to the underside of the work deck and to the upper end of the riser such that the work deck can be moved relative to the riser, the riser extending from the slip joint and down to a subsea BOP which is arranged on the wellhead of the hydrocarbon well;

a plurality of riser tensioners each of which is connected to the slip joint such that the riser is held under tension;

a BOP which, when the system is in use, is arranged on the work deck; and a high-pressure riser which, when the system is in use, is arranged in and extends through the riser and the slip joint and is connected to the BOP on the work deck and to the subsea BOP, thereby forming a continuous high-pressure connection from the BOP on the work deck down to the hydrocarbon well.

2. A system according to claim 1, wherein the work deck is adapted to be capable of being locked against relative movement in relation to the drill floor.

3. A system according to claim 1, wherein the system comprises a plurality of first pulley sets with at least one pulley over which the respective wires of the riser tensioners run, which pulley sets are mounted on the work deck such that the wires run clear of an opening in a cellar deck, which cellar deck is arranged below the drill floor.

4. A system according to claim 3, wherein the first pulley sets are mounted on the underside of the work deck.

5. A system according to claim 1, wherein the wellhead of the hydrocarbon well, with the mounted subsea BOP, is arranged on or close to the bottom of the body of water.

6. A system according to claim 1, wherein the floating arrangement is a drilling rig or drill ship.

7. A method comprising the step of using the system according to claim 1 for managed pressure drilling of a hydrocarbon well or for intervention of a hydrocarbon well.

8. A system according to claim 2, wherein the system comprises a plurality of first pulley sets with at least one pulley over which the respective wires of the riser tensioners run, which pulley sets are mounted on the work deck such that the wires run clear of an opening in a cellar deck, which cellar deck is arranged below the drill floor.

9. A system according to claim 2, wherein the wellhead of the hydrocarbon well, with the mounted subsea BOP, is arranged on or close to the bottom of the body of water.

10. A system according to claim 3, wherein the wellhead of the hydrocarbon well, with the mounted subsea BOP, is arranged on or close to the bottom of the body of water.

11. A system according to claim 4, wherein the wellhead of the hydrocarbon well, with the mounted subsea BOP, is arranged on or close to the bottom of the body of water.

12. A system according to claim 2, wherein the floating arrangement is a drilling rig or drill ship.

13. A system according to claim 3, wherein the floating arrangement is a drilling rig or drill ship.

14. A system according to claim 4, wherein the floating arrangement is a drilling rig or drill ship.

15. A method for connecting up a system for managed pressure drilling and for workover of a hydrocarbon well, the system comprising:

a floating structure that is located in a body of water, the floating structure comprises a drill floor and a work deck is movably arranged in an essentially vertical direction in relation to the drill floor;

a riser with a slip joint, the riser extending from the work deck down to a subsea BOP arranged on the wellhead of the hydrocarbon well;

a plurality of riser tensioners, each of which is connected to the slip joint and compensates for heave motions such that the riser is held under tension;

wherein the work deck is arranged in a fixed position in relation to the drill floor;

a high-pressure riser is passed down through the slip joint and the riser such that the high-pressure riser extends from the work deck down to a predetermined distance above the subsea BOP;

the high-pressure riser is connected to a BOP that is arranged on the work deck;

the work deck is released from the drill floor and is lowered until the high-pressure riser engages with and is locked to the subsea BOP, thereby establishing a high-pressure connection between the hydrocarbon well and the work floor on the floating structure.

16. A method according to claim 15, wherein the BOP is arranged on the work deck and connected to the high-pressure riser after the high-pressure riser has been passed down through the slip joint and the riser.

17. A method according to claim 15, wherein the BOP is arranged on the work deck and that the high-pressure riser is then passed down through the BOP, the slip joint and the riser after which the high-pressure riser is connected to the BOP.

18. A method according to claim 15, wherein the work deck is suspended from lifting gear which is capable of holding the weight of the work deck, the BOP and the high-pressure riser and that the work deck is lowered by the lifting gear.

19. A method according to claim 15, wherein the slip joint is locked in its position when the high-pressure riser has engaged with a wellhead valve device.

20. The method according to claim 15, comprising the step of using the system in managed pressure drilling of a hydrocarbon well or in intervention of a hydrocarbon well.

* * * * *